United States Patent [19]

Steinegger et al.

[11] 4,087,080

[45] May 2, 1978

[54] APPARATUS FOR FILTERING METAL MELTS

[75] Inventors: Alfred Steinegger, Venthone; Robert Moser, Steg, both of Switzerland

[73] Assignee: Swiss Aluminium Ltd., Chippis, Switzerland

[21] Appl. No.: 655,535

[22] Filed: Feb. 5, 1976

[30] Foreign Application Priority Data

Apr. 29, 1975 Switzerland ..... 5517/75

[51] Int. Cl.[2] ..... C21C 7/00

[52] U.S. Cl. ..... 266/88; 266/215; 266/220

[58] Field of Search ..... 75/68 R; 266/200, 215–218, 266/220, 223, 227, 231, 280, 283, 87, 88, 99

[56] References Cited

U.S. PATENT DOCUMENTS

| | | | |
|---|---|---|---|
| 1,310,998 | 7/1919 | Lloyd | 75/63 |
| 3,343,829 | 9/1967 | Coates | 266/220 |
| 3,490,897 | 1/1970 | Dore et al. | 266/218 |
| 3,550,816 | 12/1970 | Smith | 266/275 |
| 3,654,150 | 4/1972 | Eccles | 75/68 R |
| 3,743,500 | 7/1973 | Foulard et al. | 75/68 R |
| 3,753,690 | 8/1973 | Emley et al. | 266/215 |
| 3,917,242 | 11/1975 | Bass et al. | 75/68 R |

*Primary Examiner*—Gerald A. Dost
*Attorney, Agent, or Firm*—Ernest F. Marmorek

[57] ABSTRACT

A metal melt is filtered by causing the melt to flow successively into a filter chamber, downwards through the filter chamber, into a riser chamber, upwards through the riser chamber, and out of the riser chamber, and simultaneously introducing a counter-current flow of gas into the filter chamber, while the filter chamber contains a loose bed of granulate, whereas in the riser chamber there is no granulate nor is gas introduced therein.

6 Claims, 18 Drawing Figures

APPARATUS FOR FILTERING METAL MELTS

Apparatus for filtering metal melts

The invention relates to apparatus for filtering metal melts, especially aluminium melts, by use of a loose bed of granulate and with introduction of gases in counter-current.

The method of cleaning of metal melts by filtering them through a loose bed involves not only a main problem of optimizing the filtering operation itself, but also further problems: on the one hand the optimization of the thermal balance of the melt, filter chamber and bed, and on the other hand the optimum organization of the operating steps which occur on starting up and stopping the apparatus.

Hitherto, various improvements have been proposed for optimizing the filtering operation. These relate principally to the selection of the granulate of the loose bed. Thus, granulates of the most varied grain size and of the most varied materials, say corundum or petroleum coke, have been used, or attempts have been made to specially form the surface of the granulate, so as to improve its absorption ability.

Furthermore, various constructional forms of filter chambers for reception of the loose bed have been suggested, which in detail were characterized by particular combinations and geometrical arrangements of filter chambers, and which made it possible to improve the throughput of melt and the quality of the product.

In addition, for a long time, a method of melt filtration has been employed in which a finely divided non-reactive gas is blown in counter-current through the melt, so that the throughput and quality of the product can be improved simultaneously. Various devices have been described in this connection, which relate to the introduction of this gas through the wall of the filter chamber and always employ porous, gas-permeable inlet bodies in the floor of the filter chamber. Special problems arise in this connection in fastening the inlet bodies in a gas-tight and melt-tight manner in the floor of the filter chamber, consisting of fire-resistant material, and in providing for changing of these inlet bodies, which in general have shorter working lives than the filter chamber itself.

Finally, the selection and the throughput of the non-reactive gas blown in in counter-current represents a further parameter, which, especially with the employment of inert gases, influences the economics of the method significantly, and also has a profound effect on the thermal balance of the entire apparatus.

Hitherto, hardly any attention has been devoted to the second optimization problem, namely the nature of the thermal balance of the melt, loose bed and filter chamber, although this very problem is of special importance for a logical and economical performance of the method. In this connection, the principal problem arises in the maintenance of the temperature of the entire apparatus between two pourings of metal with discontinuous or semi-continuous charging. Here the thermal loss of the melt during the filtering operation must be regarded as the most important quantity for determination. This loss is determined especially by the residence time of the melt in the loose bed, that is, for given dimensions of the latter, by the throughput of melt per unit time. At the same time efforts must be made to minimize the necessary heating costs by suitable construction of the filter chamber and heating device as well as by optimum temperature control during the filtering operation. The preheating time of the device is to be regarded as a particular cause of heat losses, and minimization of this time should be separately attempted. Proposals for solution of these problems of thermals balance of filters for handling melt have hitherto been lacking.

Moreover, a suitable heating device must satisfy the requirement that it enables the entire apparatus to be held hot as long as desired between two pourings of metal, without the quality of the product being thereby harmed. With the employment of oil-heated burners, in which substantial quantities of combustion products arise, significant technical efforts are necessary for solving this requirement. Again no satisfactory solutions exist to this problem hitherto.

The third optimization problem in melt filtration relates to carrying out the operating steps for starting up and stopping of the apparatus, while the aspects of economy of working time and operational safety must be especially in the foreground. These aspects are of particular importance with discontinuous or semi-continuous operation of a filter, in which starting-up and stopping operations amount to a relatively large fraction of the working time of the apparatus. Along with the aspect of operational safety, care is needed that the loss of metal through starting and stopping of the apparatus is kept as small as possible. The problem of emptying the filter chamber after the filtering operation must be separately solved. Hitherto no concrete solutions exist for these requirements.

The present invention starts from this situation, and thus involves a further development of existing devices for melt filtration, and the objective which underlies it is to improve both the actual filtering operation, and also the thermal balance and the starting-up and stopping operations, in such a way that some of the many disadvantages of existing methods of melt filtration can be avoided.

In methods of filtering a metal melt according to the present invention, the melt is caused to flow successively into a filter chamber, downwards through the filter chamber, into a riser chamber, upwards through the riser chamber, and out of the riser chamber, while the filter chamber contains a loose bed of granulate and a counter-current flow of gas is being introduced into the filter chamber, whereas in the riser chamber there is no granulate and no introduction of gas.

Apparatus according to the present invention comprises a filter chamber and a riser chamber arranged one on each side of a dividing wall, with at least one transfer passage through the bottom portion of the dividing wall, and gas inlet devices arranged in the floor or lower side wall, or both, of the filter chamber there being no gas inlet devices in the riser chamber.

The gas inlet devices are preferably in the floor. Preferably there are at least four inlet devices uniformly distributed over the entire ground area of the filter chamber.

According to the requirements as regards the quality of the product, i.e. the filtered melt, a desired number of apparatus according to the invention can be connected together in series, while the nature of the beds in the filter chambers and the quantity of gas introduced can vary from one apparatus to another, say in such a way that relatively coarse granulate is employed in the first filter chamber, and the grain sizes of the granulates successively decrease from one filter chamber to another.

Various examples of apparatus embodying the invention are shown in the accompanying drawings and will be described in more detail below. In these drawings.

Figure 1:
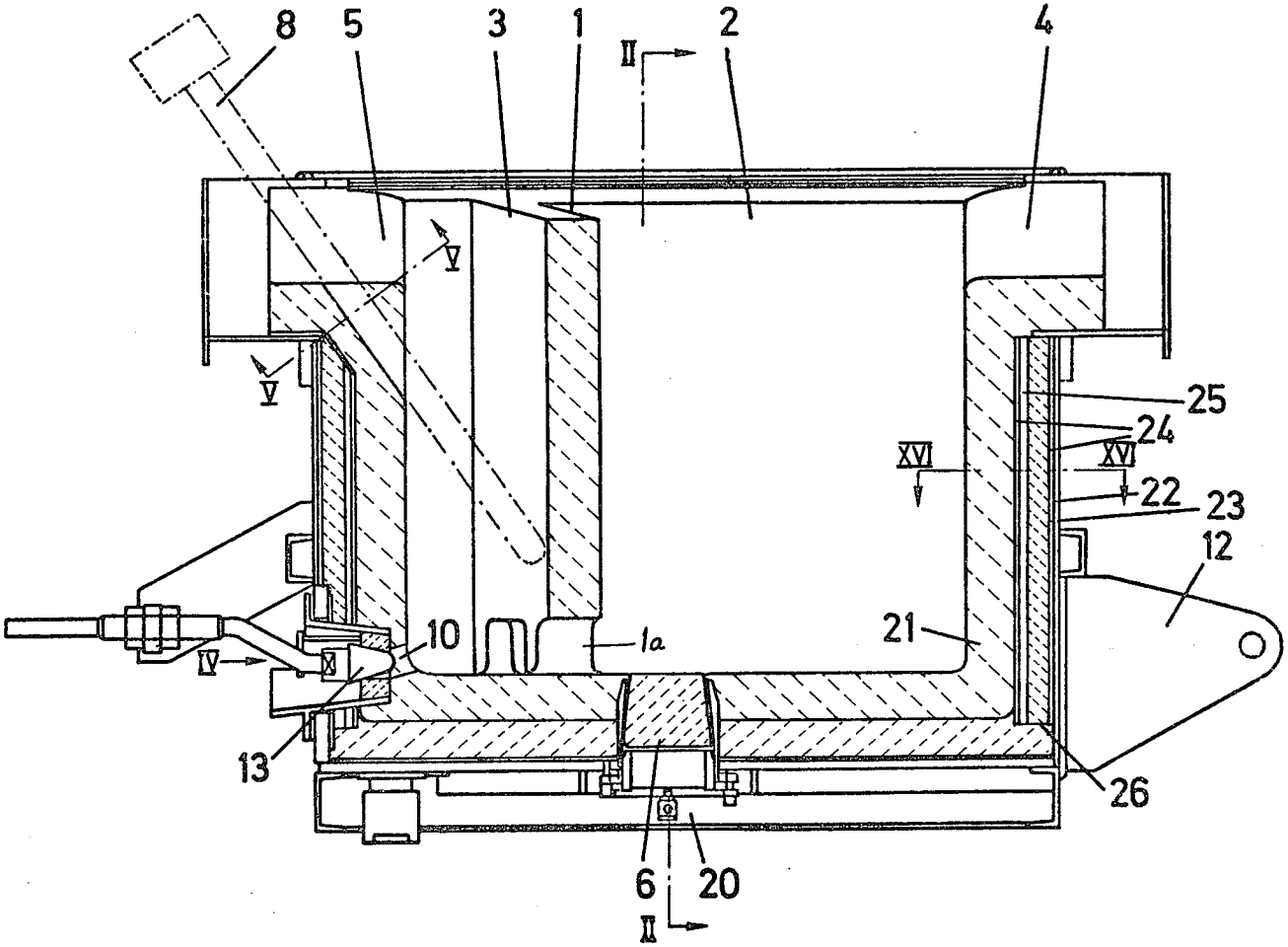
FIG. 1 shows a melt filter in longitudinal section.

The filter shown in FIGS. 1 to 5 has a cylindrical shape. The inner cylinder is divided by a dividing wall 1 into two chambers, namely a filter chamber 2 and a riser chamber 3. Several transfer passages 1*a* extend through the bottom portion of the dividing wall 1. The filter is provided with a plurality of gas inlet bricks 6. In this particular example, there are seven inlet bricks, all in the floor. Fitted to the filter chamber is an inlet channel 4. Fitted to the riser chamber is an outlet channel 5. These two channels lie at the same level.

In the example shown, the filter chamber has an active filter cross section of about 60 $dm^2$ and can accommodate a filter bed depth in the range from 0.7 to 1.0 m. In the filter chamber charged with a loose bed there is, in the filled condition, about 600 kg of melt.

Figure 6:
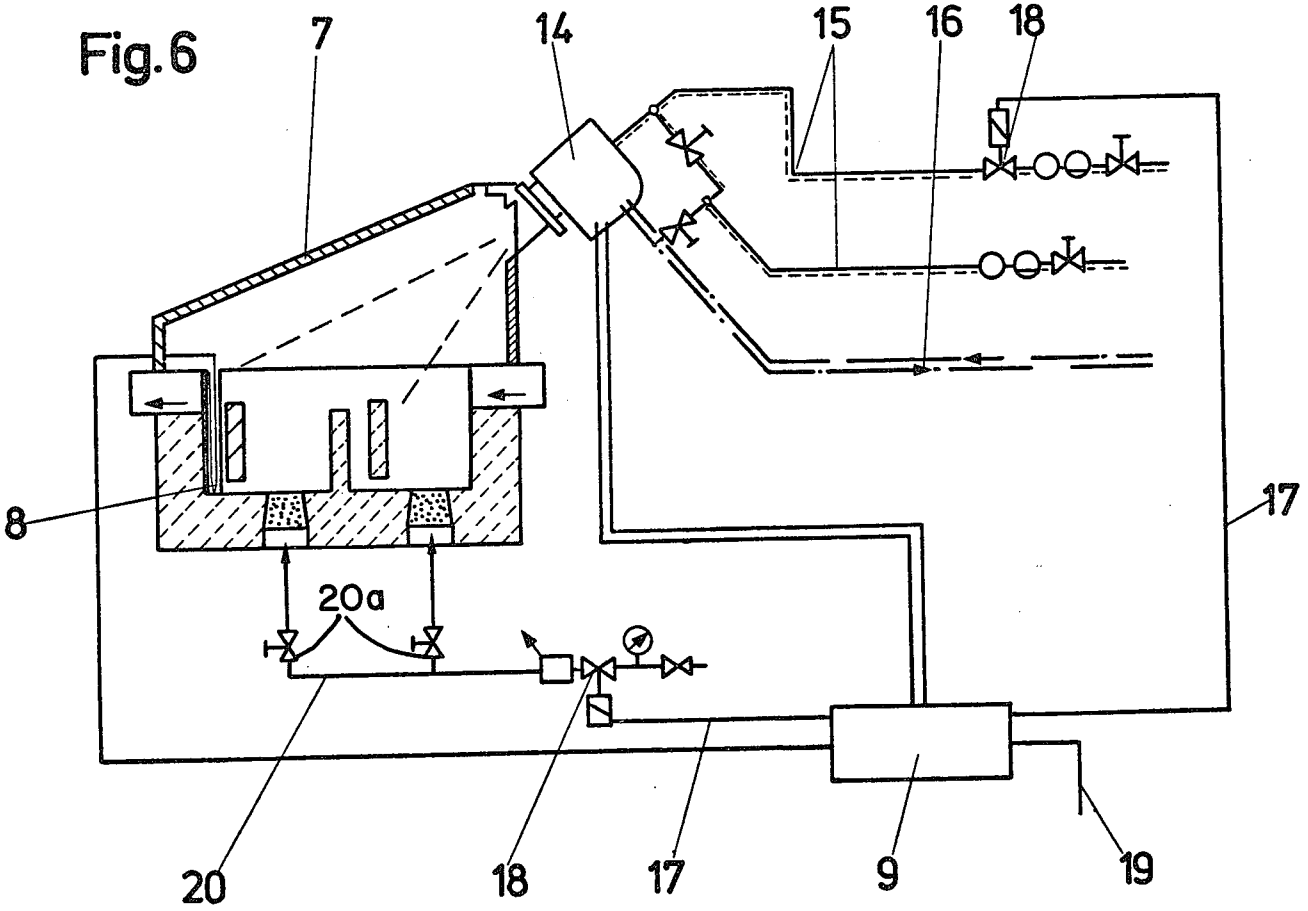
FIG. 6 is a schematic showing of the centrally controlled heating and gas inlet devices.

For heating of the apparatus, a heating cover in the form of a dome is required, which operates either with gas or oil firing or with electric heating. Such a cover is not shown in FIGS. 1 to 5, but is shown diagrammatically in FIG. 6. FIG. 6 also serves to illustrate two apparatus, each consisting of a filter chamber 2 and a riser chamber 3, arranged in series in a common housing, under a common heating cover 7. A thermo-element 8 (FIGS. 1 and 6) is inserted into the riser chamber of the downstream filter, and measures the floor temperature of the melt. On the basis of the floor temperature in the riser chamber, the heating cover 7 is controlled by an electronic controller 9 with feedback. The cover 7 as shown consists of an insulated steel dome, which covers the filter housing completely from above, and on which is mounted an oil or gas burner 14 of conventional construction, inclined 40° to the horizontal. The thermo-element 8 provides the temperature to the controller 9. This turns the burner off on attainment of the predetermined temperature, and on again on falling below. There may also be a second thermo-element, arranged to measure the surface temperature of the melt.

Since the air has a temperature of over 600° C and correspondingly rises upwards inside the heating dome 7, and the oil burner is inclined to the horizontal, it is recommended to incorporate air cooling in the burner 14, which hinders inflow of hot air as soon as the burner is turned off. This air cooling 15 is controlled by an electromagnetic valve 18 built into the air supply. This opens the air supply as soon as the burner turns off, i.e. if the temperature in the melt filter is attained, if current interruption occurs, or if the oil supply is interrupted. From the same air supply, additional combustion air is blown in through a second channel, so that the most complete possible combustion of the oil occurs. The air supplied to the oil burner, whether this is cooling air or combustion air, must be entirely free of oil and water vapour, in order not to influence the quality of the melt by combustion products. For this purpose, it is recommended to incorporate an oil and water separator of conventional construction in the air supply.

The starting up of the apparatus takes place in the following manner: The cleaned-out filter chamber is installed in a suitable position, and the filter chamber 2 is partly filled, to a depth of 20 to 30 cm, with granulate in a loose bed. Thereafter the inlet and outlet channels 4, 5 can be connected. The thermo-element 8 is inserted in a groove in the lining of the riser chamber 3 (FIG. 4), and a stopper 13 for closure of a tapping opening 10 is inserted, or if it has been inserted already earlier, its tightness is checked.

The heating cover 7 is loosely mounted upon the filter, so that the oil gas-heated burner 14 lies above the filter inlet 4. The filter inlet 4 is fully blocked with insulating material of asbestos, and the filter outlet 5 to ⅔ of its height. Then in succession there are switched on the two supplies for combustion and cooling air 15, the two oil supply conduits 16, the thermo-element 8, and the control connection 17 for the magnetic valve 18.

The electronic controller 9 is adjusted to the operating temperature, and then the current supply 19 is turned on with a main switch. In about 8 hours the melt filter reaches the chosen operating temperature. Then more granulate is charged into the filter chamber 2 to complete the full depth of a loose bed. For this purpose the current supply is interrupted and thereafter the heating cover is removed. If the granulate of the bed is supplied in cold condition, then additionally there must be preheating for three to four hours with the heating cover 7, before pouring of melt can occur. If the bed is already preheated to the operating temperature in a furnace, then pouring can occur immediately after the filling of the filter chamber 2. It has generally appeared as an advantage, that the bed is charged in the described manner in two stages, independently of whether the temperature of the charged granulate corresponds to the operating temperature, or whether it is introduced in the cold condition.

The actual filtration operation works on the following principle: A valve 20*a* is opened and admits a flow of non-reactive gas to the gas inlet bricks 6 via supply pipes 20. The metal melt enters the filter chamber 2 through the filter inlet channel 4 and flows downwards through the loose bed. At the same time the non-reactive gas emerges in the form of finely divided jets from the porous gas inlet bricks 6 built into the outer wall (floor or lower part of the side walls) of each filter chamber, and rises upwards in counter-current through the metal melt and loose bed. The inert flushing gas transports oxides, hydrogen, and other impurities to the surface of the metal melt. There solid impurities can easily be scraped off from time to time, by conventional methods. The melt, cleaned in this way, flows through the transfer passages 1*a* at the bottom of the dividing wall 1 into the riser chamber 3, in which it flows upwards, and into the outlet channel 5.

Before the flow of metal melt is started, one must take care that the filter chamber 2 is filled with the loose bed, and that the operating temperature has been reached even on the bottom of the riser chamber 3. Furthermore, the inlet and outlet channels 4, 5 must be connected, and the flushing gas supply pipes 20 must be connected up. Then the heating cover 7 is removed, and the insulation material is removed from the inlet and outlet channels 4, 5. Then one allows the melt to flow into the filter chamber 2, and begins at the same time to introduce the necessary quantity of flushing gas.

During the supply of metal melt, the rate of flow of non-reactive gas should be so adjusted that it causes a uniform pattern of jets, and that no excessive cooling down of the melt arises in consequence.

When the flow of melt ceases, the non-reactive gas supply is turned off, and the melt surface is scraped. If a larger interval arises between two throughputs of metal, then one taps off the melt through the tapping opening 10 by means of the removable stopper 13. Also if one wishes to change from filtering of one alloy to filtering of another, one taps off the first melt, and can then at once begin with filtration of the other alloy. If the filter is very large, then there may be more than one opening 10 with associated removable stopper 13.

If for operational reasons the loose bed must be removed in the hot condition, then one proceeds as follows: The stopped-up melt filter is transferred by means of pivot pins 11 provided on the outer wall, and with employment of a crane, into the bearings of a conventional tipping stand, and there held as required. Then the filter chamber is lifted with the crane at a supporting lug 12, and rotated in such a way that the loose bed falls over the dividing wall 1 into a trolley or the like ready to receive it.

If, with discontinuous operation of the melt filter, melt is passed through again after a relatively short interval of time, then one can avoid tapping off and emptying the melt, and instead the melt can be kept hot in the filter chamber for any desired length of time. For thispurpose, the inlet 4 and the outlet 5 are blocked up to two thirds. Then one again places the heating cover 7 on the flow housing and turns on the heating. When keeping hot for a period of 2.5 hours, one could not find in an operational example any significant influence of the oil or gas firing on the hydrogen content of the melt. Only after keeping hot for over 20 hours was it found that the melt after passing through the filter had a greater hydrogen content than before passing through. By the incorporation of a water and oil separator in the supply conduit for cooling and combustion air 15, one can largely eliminate even this negative influence, so that the metal melt can be kept hot in the flow chamber during nearly any desired period of time.

Particular attention is to be directed to the optimum formation of the lining and insulation of the filter chamber, because these two features significantly determine both the thermal balance and the working life of the plant: If the insulation and the lining is of optimum formation, then one can reckon on a working life of the entire device of 8 to 12 months. Only the dividing wall 1 must be replaced sooner, after 5 to 6 months of continuous operation. With previous filters, small defective places appear in the dividing wall after 3 to 4 months. The average working life of the dividing wall in an arrangement according to the invention is thus about 50% longer than that of conventional filter chambers.

Figure 2:
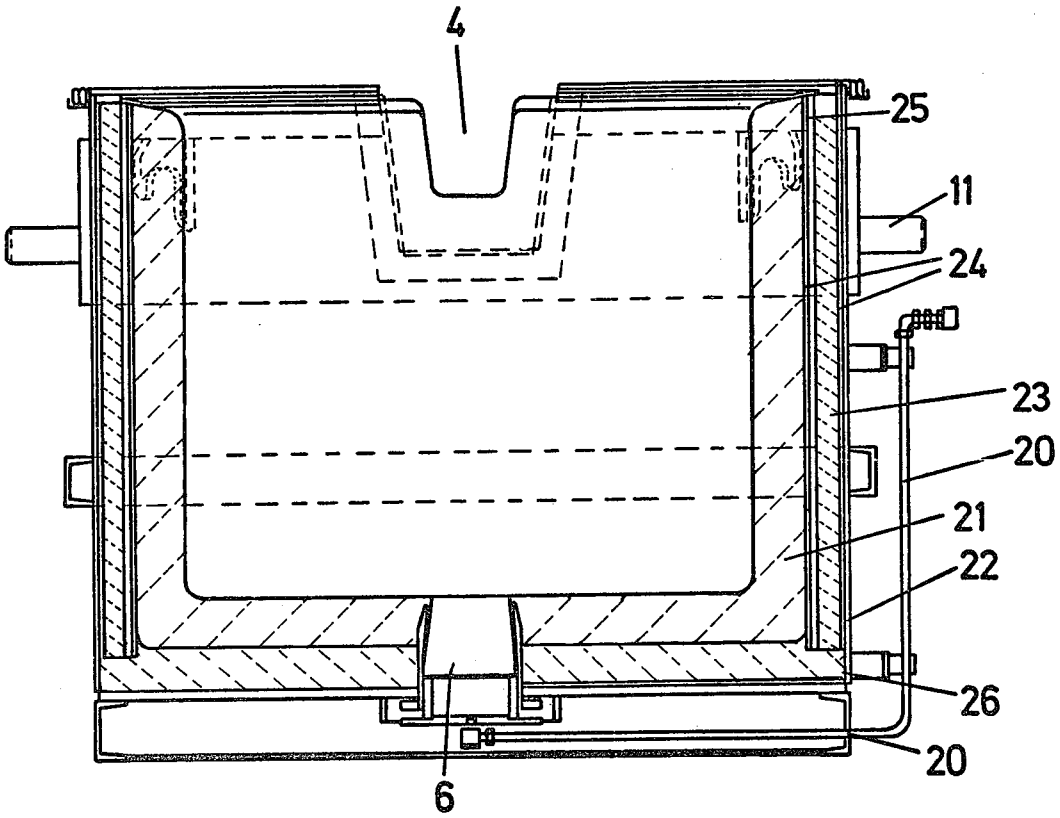
FIG. 2 is a transverse section on the line II — II in FIG. 1.
Figure 3:
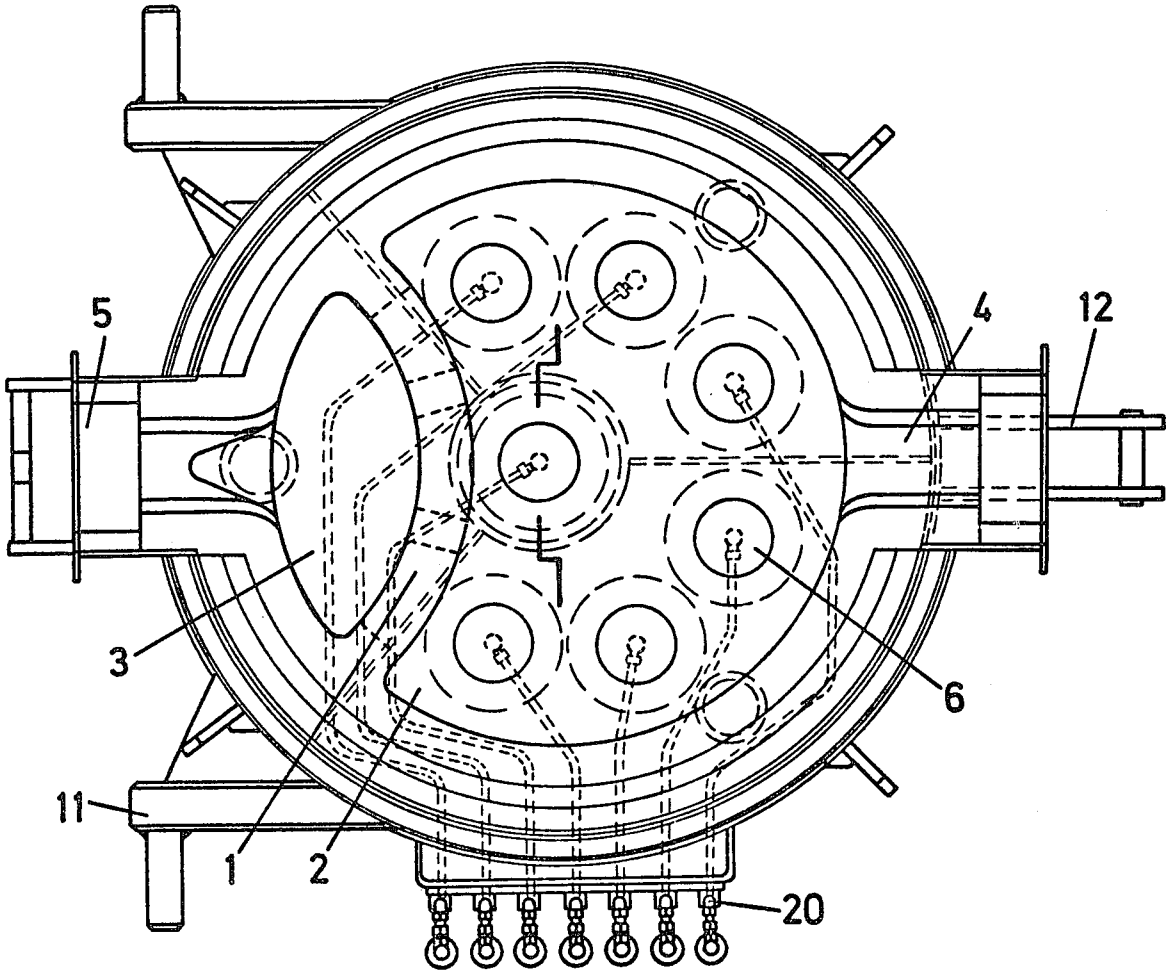
FIG. 3 is a plan of the melt filter from above.
Figure 4:
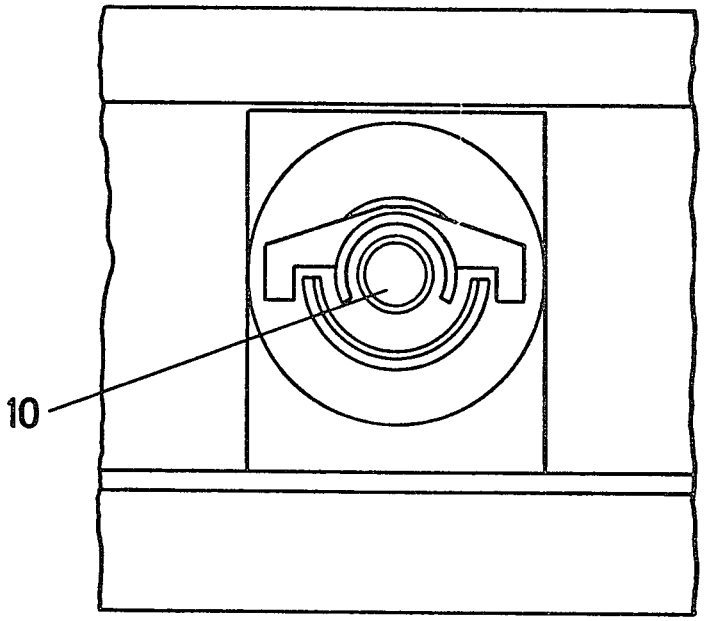
FIG. 4 is an enlarged view in accordance with the arrow IV in FIG. 1.
Figure 5:
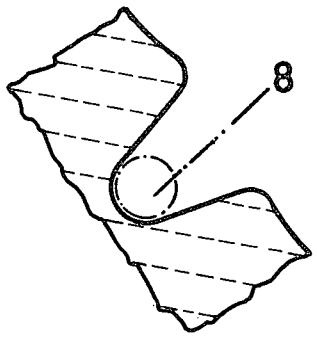
FIG. 5 is an enlarged detail according to the line V — V in FIG. 1.
Figure 16:
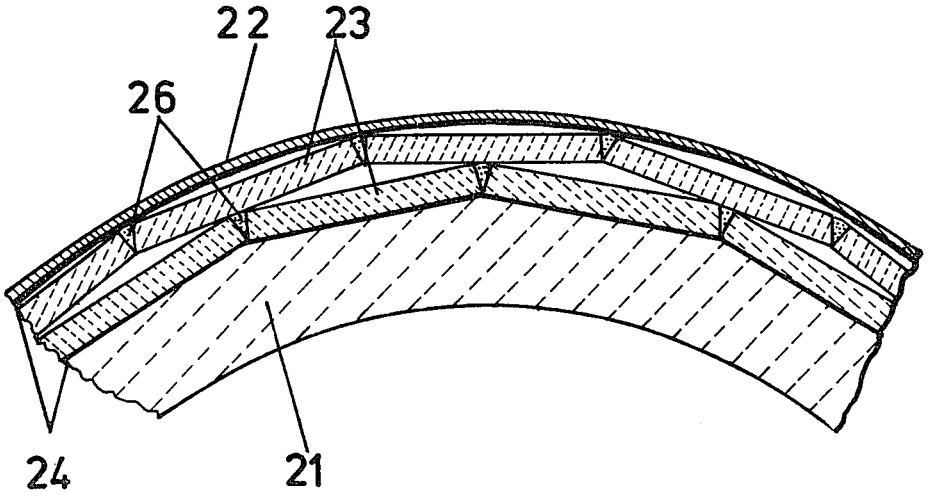
FIG. 16 is a section through the wall of a melt filter on the line XVI—XVI in FIG. 1.

In the example shown in FIGS. 1, 2 and 16, the filter wall consists of a steel casing 22, covered on its inner side by a layer 24 of a solid insulating material 2 mm thick, at least two layers of insulating plates 23 of preburnt material, each covered on their inner side with a layer of insulating material 2 mm thick, and one layer of fire-resistant concrete 21. (In FIGS. 1 and 2, for simplicity, only one layer of plates 23 is shown).

In preparing the insulation, the greatest care must be employed to prevent metal flowing through fine hair cracks in the insulation in continuous operation, solidifying in the insulation, and carrying significant quantities of heat outwards after the manner of a cooling rib. If one burnt the insulating plates 23 in a furnace for a long period at a correspondingly high temperature before incorporation in the filter, then the formation of such "cooling ribs" at the meeting places of the plates could be reduced by half. By pointing the meeting places with a suitable plastic insulating material 26, and by sticking on additional layers of the solid insulating material 24, the formation of "cooling ribs" can be practically completely eliminated.

The finely-ground, fire-resistant concrete employed for the lining 21 is poured and consolidated with a vibrator according to conventional methods. Before the pouring of the lining, the insulating layer 24 must be covered in a water-tight manner, as indicated at 25 in FIGS. 1 and 2, so that the insulation does not withdraw any moisture from the cement. The floor of the filter chamber and the outer covering are cast in one operation. The dividing wall 1 is poured after de-shuttering of the lining wall 21, say 6 to 12 hours after the pouring of the lining. Then there follows an air drying for at least 24 hours, and finally a slow heating and sintering at a higher temperature than the operating temperature.

For optimization of the thermal balance of the apparatus, the two chambers are arranged adjacent to each other in the most compact possible construction, while the total ground area is chosen to be as compact as possible, for example circular. Various alternative circular constructions are described later, with reference to FIGS. 7 to 15. It has appeared surprisingly that such a two-chamber device, consisting of the combination of a filter chamber which is supplied with gas and provided with a bed, and of a riser chamber, which has neither gas introduction nor bed, optimizes the flow capacity of the melt filter for a predetermined volume of the bed and a predetermined quality of the product.

A linear relationship must exist between the active volume of the bed and the throughput of the melt per hour for a given quality of product and constant composition of the granulate of the bed, regardless of whether the filters are built according to previous notions or according to the present invention.

Figure 17:
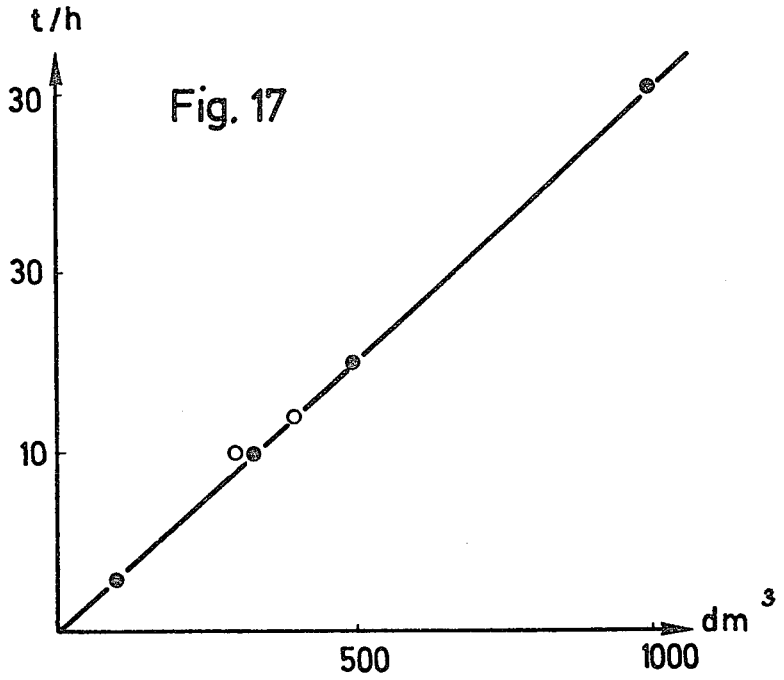
FIG. 17 is a diagram to show the throughput capacity of various melt filters measured in *t/h* in relation to volumes of bed, measured in $dm^3$.

This information is displayed in FIG. 17, in which are marked off on the abscissa the volume of the bed in $dm^3$, and on the ordinate the throughput capacity of the device in *t/h*. Here melt filters which are built according to the invention correspond to the solid points (•—•), and melt filters according to a conventional construction (for example according to German OS 2 019 538) correspond to the hollow points (O—O).

Figure 18:
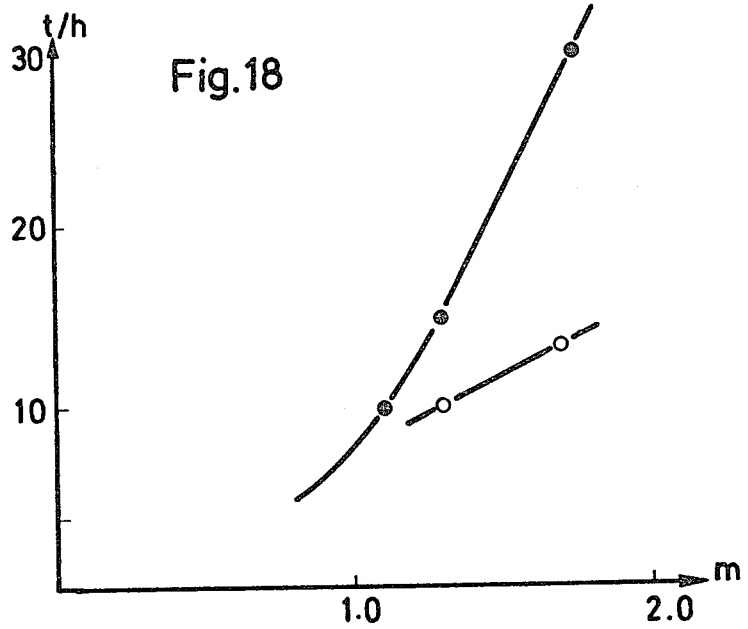
FIG. 18 is a diagram to show the throughput capacity of various melt filters measured in *t/h* in relation to the external dimensions (diameters) of filter housings, measured in m.

If, however, one relates the throughput of melt per unit time with the external dimensions of the filter chamber, then it appears that the filters according to the invention employ a given available active volume of bed significantly better than the arrangements previously known, even the one with a central filter chamber. The filters according to the invention, in a compact construction, with corresponding dimensions can achieve significantly higher throughputs of metal. This is shown in FIG. 18, in which the abscissa corresponds to the external diameter of the device in *m*, the ordinate to the throughput capacity in *t/h*.

In a working example, in which the hydrogen content of an aluminium melt had to be reduced by 50%, the throughput with an external diameter of the filter chamber of 1.3 m in a conventional filter with a central filter chamber amounted to 10 *t/h*, while in contrast in a filter according to the invention it amounted to 15 *t/h*. With an external diameter of 1.7 m the throughput with a conventionally built filter rose to 12 *t/h*, and in contrast with the filter according to the invention to 30 *t/h* (c.f. FIG. 18).

A full explanation is not available why the two-chamber device of compact construction according to the invention should produce such a marked optimization effect for the entire process. All other methods proposed hitherto, especially those with central filter chambers and those which employ other than the combination proposed here of gassed/not-gassed and granulate-filled/empty chambers, do not permit closely comparable throughputs of metal for a given quality of the product and the same external dimension of the flow chamber. Here it is of particular importance, that no inert gas is introduced into the riser chamber, because gassing of a chamber filled only with melt without the relatively firm structure of a bed leads to turbulence, eddying and similar hydrodynamically disadvantageous phenomena in the metal melt, which negatively influence the throughput capacity. Furthermore an introduction of gas into the riser chamber is disadvantageous for the thermal balance, because it can lead to unnecessary cooling down of the melt, even so far as solidification of the latter in peripheral places.

It has moreover appeared that the proportion of the volumes of the filter chamber to the riser chamber should preferably be above 4. If the riser chamber is chosen larger, then valuable volume of the filter chamber is lost in an uneconomical manner, and the effect is less marked that as shown in FIG. 18.

As compared with filters previously known, the filters according to the invention achieve a significant improvement of the thermal balance. The combination of the effects of a compact construction of the two-chamber apparatus, a multi-layer insulation of the filter chamber, and central control of heating and gas introduction, reduce the thermal losses during the filtration of the melt, during the unavoidable heating-up steps, and during maintenance of the temperature of the melt in the filter chamber between two pourings of metal. The shortening of the time of residence of the melt in the filter chamber operates in the direction of minimizing the thermal losses.

Furthermore, the central temperature control enables one to operate with the temperature close to the solidification point of the melt, and thus to operate significantly more cheaply, without at the same time risking that the melt should partially solidify in the last chamber traversed, as frequently occurs in the existing apparatus. This is particularly so if one measures both the temperature at the bottom of the riser chamber and the temperature at the surface of the filter chamber.

The arrangement of the heating means in a dome further permits a supply of the thermal requirements by the most direct route, without thermal demands on the walls of the filter chamber, as mostly arises in the heating arrangements in previous filters. Such a heating dome can be operated electrically or with gas or oil firing, and extended working tests have shown a reduction of heating costs by a maximum of 37%.

Of importance also for an optimum thermal balance is a central control of the introduction of the non-reactive gas into the filter chamber, so that one can avoid the melt being excessively cooled down by the cold non-reactive gas, and at all events so far as to be locally solidified. It has appeared in extended working tests that the cooling down can be limited to the most economical without endangering the purifying process, if a gas inlet brick of about 2 $dm^2$ cross section is used for 5 to 10 $dm^2$ cross section of the loose bed. This makes it possible to hold the gas consumption with all throughput loadings at less than 0.5 $Nm^3$ gas per ton of filtered aluminium, and to limit the temperature difference of the melt between inlet and outlet from the filter housing to 10° or in exceptional cases 15°.

The central control of the heating and cooling is of particularly great importance in operational conditions in which the melt must be maintained hot in the filter housing for a long period between two pourings of metal. While hitherto no concrete proposals exist of solutions for this problem, the apparatus shown here permits maintenance of the temperature in the filter housing during any desired period of time, so that it is only after more than 20 hours, and only with the employment of gas or oil firing, that an effect can be found on the hydrogen content of the melt to be kept hot.

Moreover the apparatus shown improved each of the operating steps which are necessary when starting up and stopping the operation. Then it makes possible both reduction of the necessary working time, and also improvement of the operational safety of the plant. If the bed is removed from the filter chamber, then this should occur in the heated condition, because the presence of melt residues always leaves the possibility that the bed will stick together on cooling and become firmly baked in the filter chamber. Hitherto, this work has been dealt with by shovelling by hand, which brings with it the disadvantage of high labor intensity and poor operational safety. These disadvantages are eliminated by constructing the filter housing so as to be transportable, while the gas supply can be easily disconnected. In this way, as described above, shifting of the device by means of a fork-lift truck or crane is permitted, followed by tipping so that the bed falls over the dividing wall into a trolley or the like prepared for it. This arrangement enables one to economize in more than 50% of the working time otherwise employed for manual shovelling out. In addition it provides significant improvement of operational safety and in working conditions for the labor force engaged in the melt filtration operation.

Figure 8:
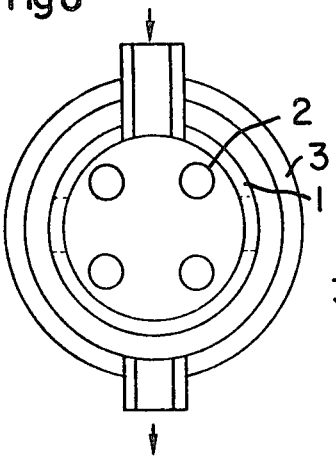
Figure 9:
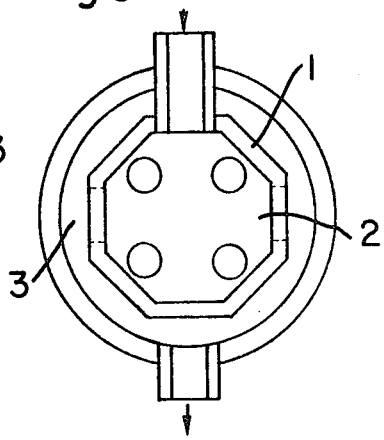
Figure 10:
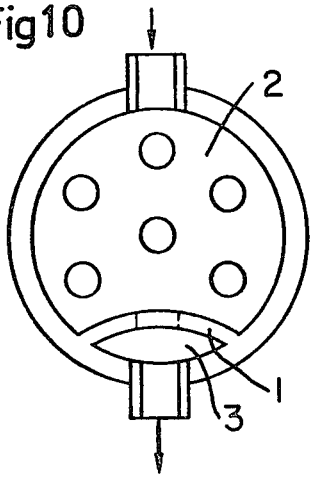

FIGS. 7 to 15 show alternative ground plans, in a diagrammatic way, on a small scale. FIG. 10 is the same as FIG. 3, already described. That is to say the riser chamber 3 has a lens-shaped cross section, the dividing wall 1 has a parabolic or annular-sector-shaped ground plan, and the filter chamber 2 makes up the total ground plan to a circle.

Figure 7:
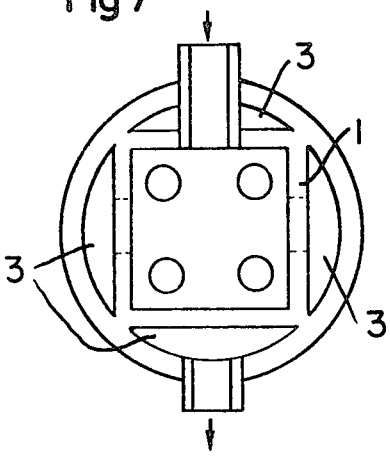
FIGS. 7 to 15 are comparative illustrations of possible ground plans for melt filters.

In FIG. 7, the filter chamber 2 and dividing wall 1 have rectangular ground plans, and the device has four riser chambers 3 with circular-segment-shaped ground plans, which are in intercommunication, and make up the total ground plan to a circle.

In FIG. 8, the filter chamber 2 has a circular ground plan, and the riser chamber 3 is arranged as a concentric annulus around the periphery of the filter chamber 2.

In FIG. 9, the filter chamber 2 and dividing wall 1 have an octagonal ground plan, and the riser chamber 3 is arranged around the periphery of the octagon, and makes up the total ground plan to a circle.

Figure 11:
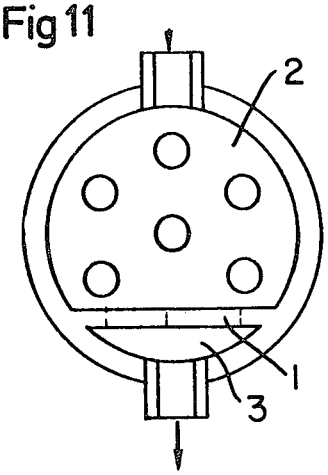

In FIG. 11, the dividing wall 1 forms a secant in the circular ground plan of the entire device, and the filter chamber 2 and riser chamber 3 form segments in ground plan, and make up the total ground plan to a circle.

Figure 12:
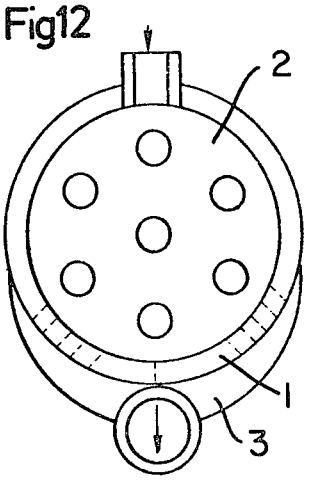

In FIG. 12, the dividing wall 1 is formed from a sector of a circular arc, the filter chamber 2 has a circular ground plan, and the riser chamber 3, with a sickle-shaped ground plan, is arranged against the periphery of the filter chamber 2.

Figure 13:
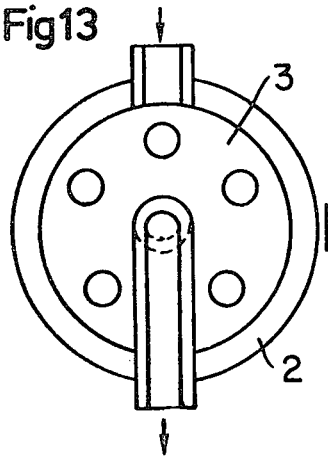

In FIG. 13, the riser chamber 3 has a circular ground plan, and the filter chamber 2 is arranged as a concentric annulus around the periphery of the riser chamber 3.

Figure 14:
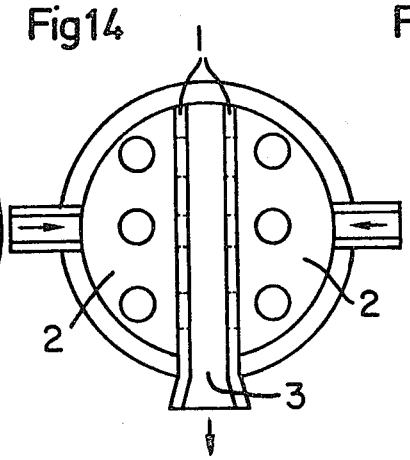

In FIG. 14, two parallel dividing walls 1 form secants in the circular total ground plan, the two filter chambers 2 have circular-segment-shaped ground plans, and the riser chamber 3 is arranged as a rectangle in the centre of the entire device, and makes up the total ground plan to a circle.

Figure 15:
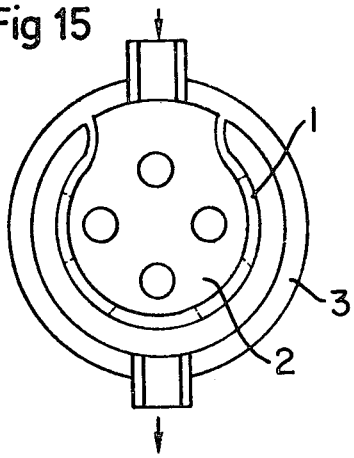

In FIG. 15, the dividing wall 1 has an annular-sector-shaped ground plan, and is permanently connected at two places with the wall of the filter chamber, the riser chamber 3 likewise has an annular-sector-shaped ground plan and is arranged at the periphery of the device, and the filter chamber 2 is arranged in the centre of the device, and its ground plan makes up the total ground plan to a circle.

What we claim is:

1. An apparatus for filtering a metal melt, comprising in combination:

a filter chamber adapted to contain filter material and to receive in a downward flow the molten metal, said filter chamber including a first lower portion having at least one gas inlet device adapted to admit a nonreactive gas in counter-current into the descending molten metal;

a riser chamber having a second lower position;

a dome-shaped cover for said chambers;

a hydrocarbon burner mounted in the cover and operable to heat said chamber from above;

means defining a transfer conduit interconnecting said chambers interiorly, operable to admit of the passage of liquid and adapted to restain the passage of filter material from the filter chamber into the riser chamber;

an electronic controller arranged to control the supply of gas to both the gas inlet device and the hydrocarbon burner, and a thermo-element disposed in said riser chamber near said second lower portion and operably connected to transmit temperature measurements to said controller.

2. Apparatus according to claim 1, in which there are at least four said inlet devices, uniformly distributed over said lower portion.

3. Apparatus according to claim 1, in which said gas inlet devices are operable to be readily exchanged.

4. Apparatus according to claim 1, in which there is means defining a closeable tapping opening in a wall of said filter chamber near said first lower portion.

5. Apparatus according to claim 1, including a suspension lug and two pivot pins on the outside of said apparatus to facilitate dumping of the filter material.

6. An apparatus for filtering a metal melt, comprising in combination:

a filter chamber adapted to contain filter material and to receive in a downward flow the molten metal, said filter chamber including a lower portion having at least one gas inlet device adapted to admit gas in countercurrent into the descending molten metal;

a riser chamber, means defining a transfer conduit interconnecting said chambers interiorly, operable to admit of the passage of liquid and adapted to restrain the passage of filter material from the filter chamber into the riser chamber, said filter and riser chambers being disposed in a housing, said housing being defined by a peripheral wall which includes in succession from outside inwards, a steel shell, at least two layers of preburnt insulation plates, and a layer of fire-resistant concrete; the inner sides of the shell and of the plates being covered by thin layers of solid insulating material.

* * * * *